US005920304A

United States Patent [19]

Berstis

[11] Patent Number: 5,920,304

[45] Date of Patent: Jul. 6, 1999

[54] RANDOM BOUNCE CURSOR MODE AFTER CESSATION OF USER INPUT

[75] Inventor: Viktors Berstis, Austin, Tex.

[73] Assignee: International Business Machines Corporation, Armonk, N.Y.

[21] Appl. No.: 08/801,689

[22] Filed: Feb. 18, 1997

[51] Int. Cl.[6] ..... G09G 5/08

[52] U.S. Cl. ..... 345/145; 345/157; 345/159; 345/160

[58] Field of Search ..... 345/145, 156, 345/157, 159, 160, 162, 163, 326, 339

[56] References Cited

U.S. PATENT DOCUMENTS

| | | | |
|---|---|---|---|
| 5,197,124 | 3/1993 | Busboom et al. . | |
| 5,230,063 | 7/1993 | Hoeber et al. | 395/156 |
| 5,276,797 | 1/1994 | Bateman et al. | 395/161 |
| 5,488,685 | 1/1996 | Palmer et al. | 395/157 |
| 5,546,521 | 8/1996 | Martinez | 395/155 |
| 5,646,647 | 7/1997 | Chow | 345/145 |

FOREIGN PATENT DOCUMENTS 2166627 5/1996 United Kingdom .

OTHER PUBLICATIONS

IBM Technical Disclosure Bulletin vol. 28, No. 6 Nov. 1985, Button Interface With Visual Cues, pp. 2648–2652.

*Primary Examiner*—Vijay Shankar
*Attorney, Agent, or Firm*—Jeffrey S. LaBaw

[57] ABSTRACT

A user interface for a computer system display in which a random bounce mode is entered after a period of inactivity by the user. A timer is started at the cessation of user input. Once the timer has reached a predetermined threshold, e.g., one to five minutes, a random bounce mode is entered in which a cursor is continuously moved in the user interface. The system exits the random bounce mode once user input to the computer system is detected.

18 Claims, 9 Drawing Sheets

RANDOM BOUNCE CURSOR MODE AFTER CESSATION OF USER INPUT

BACKGROUND OF THE INVENTION

The present invention relates generally to data processing systems. More particularly, it relates to a control mechanism for a graphical user interface.

It has long been an objective of the designers of computer systems to make their systems more accessible, or "user friendly", to a diverse group of users. Heretofore, this group of users possessed a sufficient desire or need to learn and adapt their behavior to a user interface.

While the Internet as a cultural phenomenon has raised the awareness to the tremendous information available to computer users, the largest segment of the public has yet to learn how to access these resources. Such consumers are either unmotivated, unable or too fearful to acquire the needed skills to access the Internet by conventional computer interfaces. Also, the cost of a conventional system is too high a hurdle for many. The need for low cost data processing systems which are simple to operate is being addressed to some extent by "WebTV" and similar systems. These systems are collectively known as Internet appliances.

The intended audience of the Internet appliance is such that it is expected that prior techniques for using computer interfaces would be unacceptable. Many of these consumers do not like the idea of owning a computer. The goal is to make interface as intuitive and nontechnical as possible. Preferably, the user is unaware that the interface is presented by a computer at all.

One of the problems associated with a normal user interface is that user may be unaware of the options available to him if certain portions of the interface are activated. This problem is traditionally dealt with by help programs or documentation online which must be manually called by the user. However, the novice user is fearful of pressing buttons and activating such features because it may send a computer into an unknown and possibly unrecoverable state. Therefore, the challenge is to inform the user of the possibilities within the interface and how to take advantage of those options, yet without requiring the user to enter any sort of help state or mode.

The present invention described below describes one solution to this problem.

SUMMARY OF THE INVENTION

Therefore it is an object of this invention to provide an intuitive means of informing the user as to the options available in a user interface.

It is another object of the invention to inform the user without requiring entry into particular state or activation of any input device. These and other objects of the invention are accomplished by presenting a user interface for a computer system display in which a random bounce mode is entered after a period of inactivity by the user. A timer is started at the cessation of user input. Once the timer has reached a predetermined threshold, e.g., one to five minutes, a random bounce mode is entered in which a cursor is continuously moved in the user interface. The system exits the random bounce mode once user input to the computer system is detected.

The cursor moves along a path which substantially covers a window display area or the entire display area. The cursor appearance is changed as the cursor is position over objects in the interface. Preferably, the cursor appearance is designed to inform a user how to activate actions associated with particular objects. The movement of the cursor in the random bounce mode can be slowed over objects in the interface to allow the user to select actions at the object it is currently over.

The invention outlined above as well as additional objects, features and advantages of the present invention will be more readily understood with reference to the following detailed description.

BRIEF DESCRIPTION OF THE DRAWINGS

The invention will be best understood with reference to the following drawings.

DETAILED DESCRIPTION OF THE PREFERRED EMBODIMENT

Figure 1A:
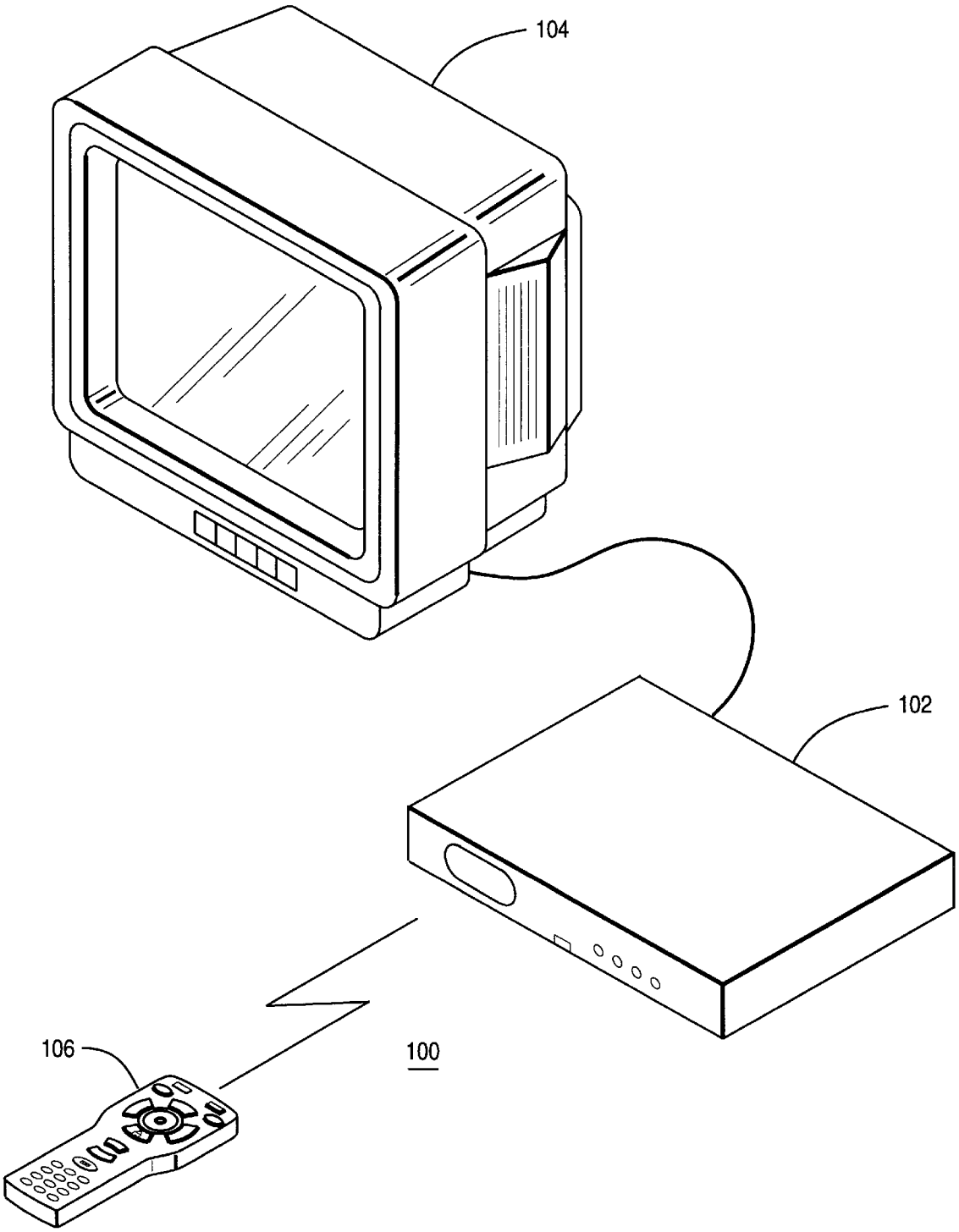
FIGS. 1A–1D depict various pictorial representations of a data processing system in which the present invention may be implemented.

With reference now to the figures and in particular with reference to FIGS. 1A through 1D, various pictorial representations of a data processing system in which a preferred embodiment of the present invention may be implemented are depicted. FIG. 1A is a pictorial representation of the data processing system as a whole. The data processing system 100 in the depicted example is an Internet appliance, providing, with minimal economic cost in hardware to the user, access to the Internet. The data processing system 100 includes a data processing unit 102. The data processing unit 102 is preferably sized to fit in typical entertainment centers and provides all required functionality which is conventionally found in personal computers to enable a user to "browse" the Internet. In addition, the data processing unit 102 may provide other common functions such as serving as an answering machine or receiving facsimile transmissions.

The data processing unit 102 is connected to the television 104 for display of graphical information. The television 104 may be any suitable television, although color televisions with an S-Video input will provide better presentations of the graphical information. The data processing unit 102 may be connected to television 104 through a standard coaxial cable connection. A remote control unit 106 allows a user to interact with and control data processing unit 102. The remote control unit 106 emits infrared (IR) signals, preferably with a different bar code pattern than the normal television, stereo, and VCR. The remote control unit 106 provides the functionality of a pointing device in conventional personal computers, including the ability to move a cursor on a display and select items.

Figure 1B:
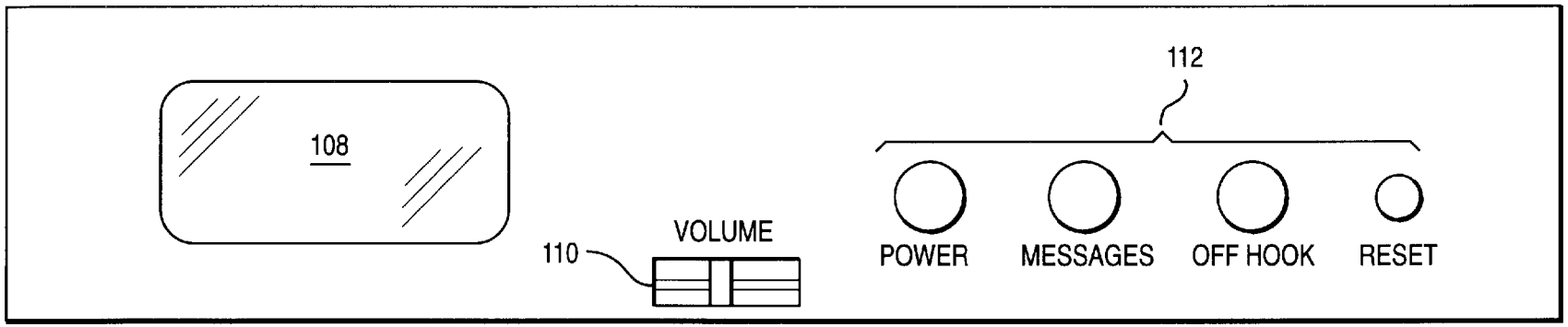

FIG. 1B is a pictorial representation of the front panel of data processing unit 102 according to with a preferred embodiment of the present invention. The front panel includes an infrared window 108 for receiving signals from the remote control unit 106 and for transmitting infrared signals. The data processing unit 102 may transmit infrared signals to be reflected off objects or surfaces, allowing data processing unit 102 to automatically control the television 104 and other infrared remote controlled devices. The volume control 110 permits adjustment of the sound level emanating from a speaker within the data processing unit 102. A plurality of light-emitting diode (LED) indicators 112 provide an indication to the user of when data processing unit 102 is on, whether the user has messages, whether the modem/phone line is in use, or whether data processing unit 102 requires service.

Figure 1C:
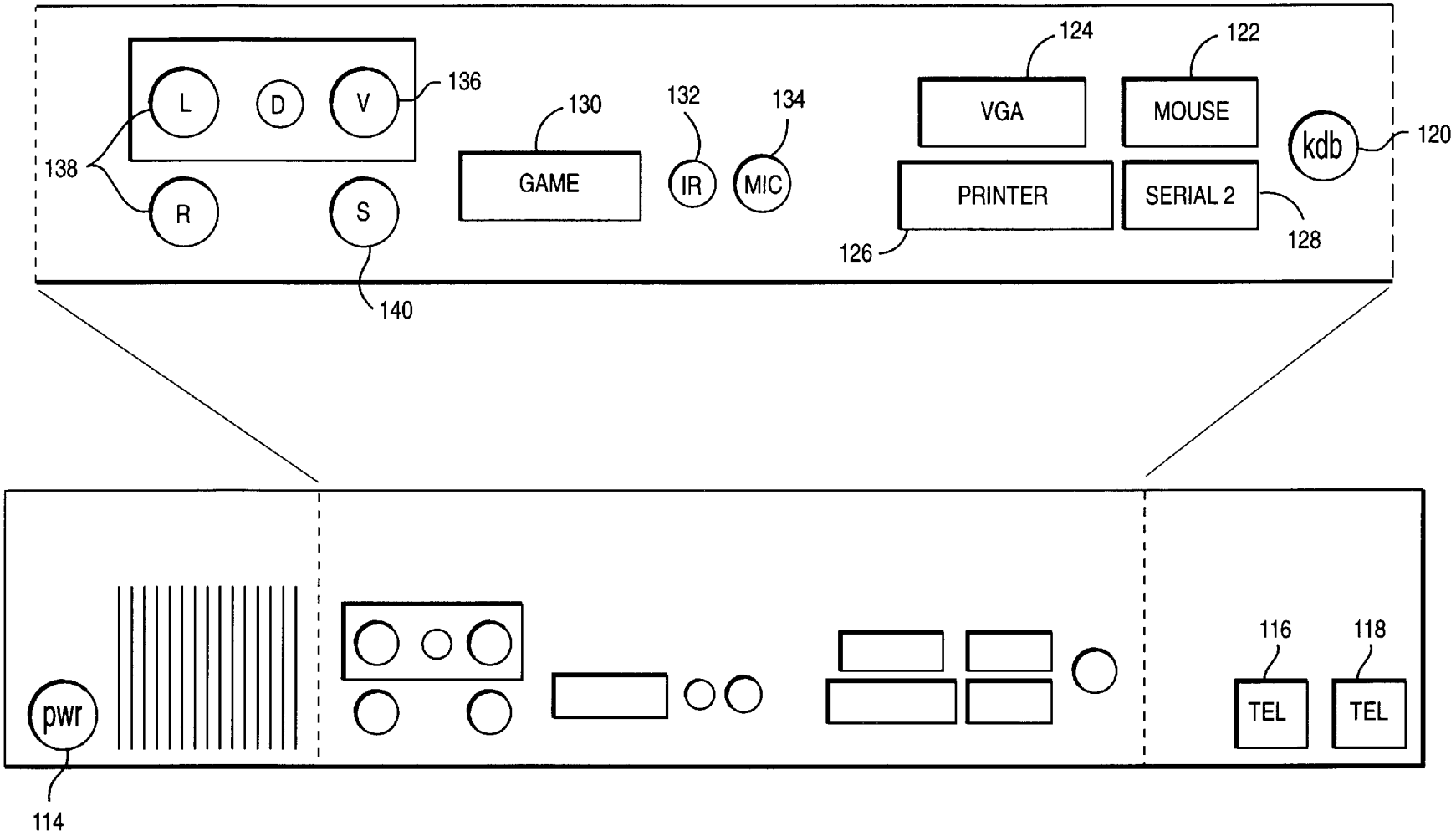

FIG. 1C is a pictorial representation of the rear panel of the data processing unit 102 in a preferred embodiment of the present invention. A three wire (ground included) insulated power cord 114 passes through the rear panel. Standard telephone jacks 116 and 118 on the rear panel provide an input to a modem from the phone line and an output to a handset (not shown). The rear panel also provides a standard computer keyboard connection 120, mouse port 122, computer monitor port 124, printer port 126, and an additional serial port 128. These connections may be employed to allow the data processing unit 102 to operate in the manner of a conventional personal computer. The game port 130 on the rear panel provides a connection for a joystick or other gaming control device (glove, etc.). The infrared extension jack 132 allows a cabled infrared LED to be utilized to transmit infrared signals. The microphone jack 134 allows an external microphone to be connected to the data processing unit 102.

The video connection 136, a standard coaxial cable connector, connects to the video-in terminal of the television 104 or a video cassette recorder (not shown). Left and right audio jacks 138 connect to the corresponding audio-in connectors on the television 104 or to a stereo (not shown). If the user has S-Video input, then S-Video connection 140 may be used to connect to the television 104 to provide a better picture than the composite signal. If the television 104 has no video inputs, an external channel 3/4 modulator (not shown) may be connected in-line with the antenna connection.

Figure 1D:
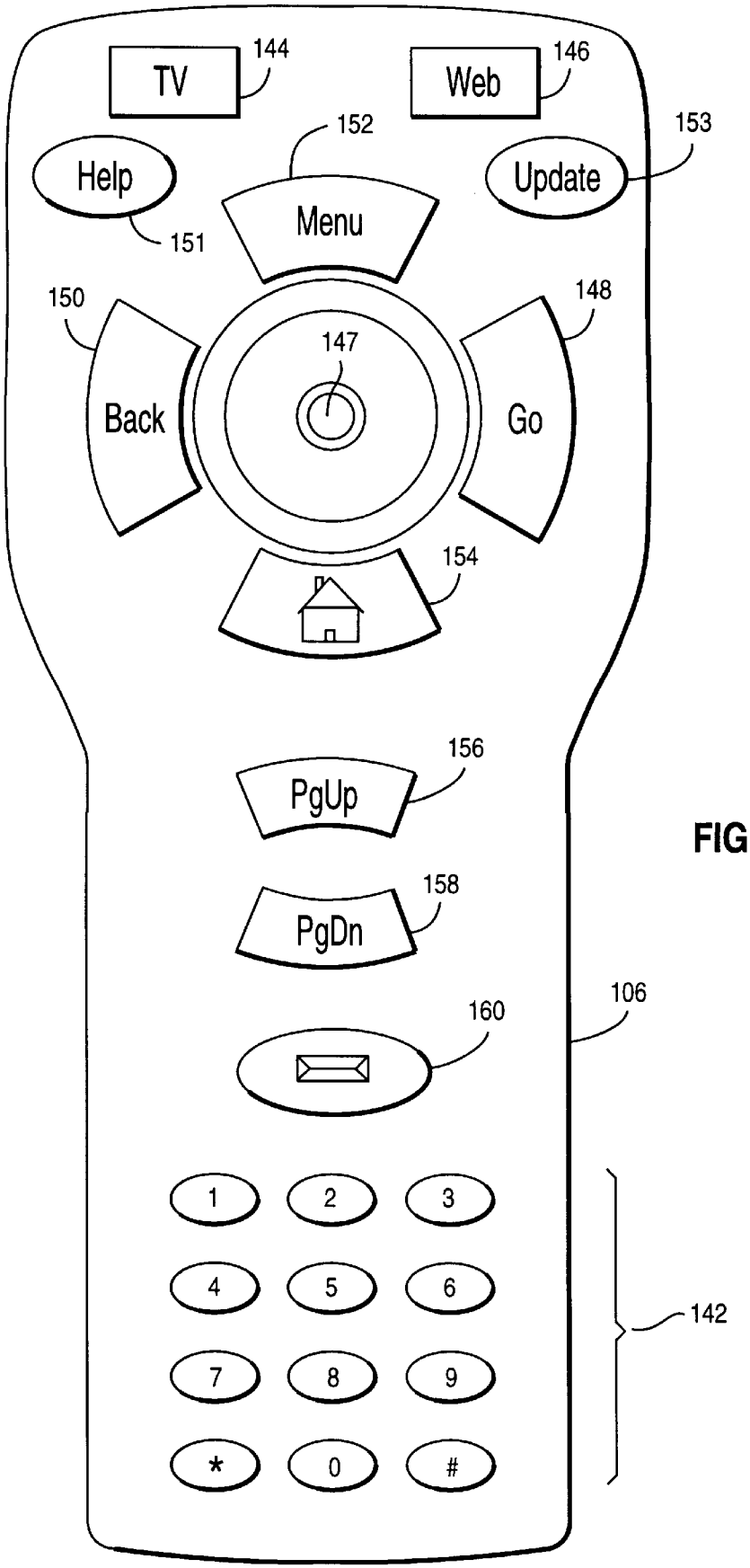

FIG. 1D is a pictorial representation of the remote control unit 106 according to a preferred embodiment of the present invention. Similar to a standard telephone keypad, the remote control unit 106 includes buttons 142 for arabic numerals 0 through 9, the asterisk or "star" symbol (*), and the pound sign (#). The remote control unit also includes a "TV" button 144 for selectively viewing television broadcasts and a "Web" button 146 for initiating "browsing" of the Internet. Pressing the "Web" button 146 will cause the data processing unit 102 to initiate modem dial-up of the user's Internet service provider and display the start-up screen for an Internet browser.

A pointing device 147, which is preferably a trackpoint or "button" pointing device, is included on the remote control unit 106 and allows a user to manipulate a cursor on the display of the television 104. The "Go" and "Back" buttons 148 and 150, respectively allow a user to select an option or return to a previous selection. In particular in the Internet context, the "GO" button 48 refers to traversing a link, i.e. going to the page, over which the cursor is located. The "Back" button 150 returns the user to the page just previously visited. The "Help" button 151 causes context-sensitive help to be displayed or otherwise provided. A "Menu" button 152 causes a context-sensitive menu of options to be displayed, and an "Update" button 153 will update the options displayed based on the user's input, while the "Home" button 154 allows to user to return to a default display of options. "PgUp" and The "PgDn" buttons 156 and 158 allows the user to change the content of the display in display-sized blocks rather than by scrolling. The "Message" button 160 allows the user to retrieve messages.

In addition to, or in lieu of, the remote control unit 106, an infrared keyboard (not shown) with an integral pointing device may be used to control data processing unit 102. The integral pointing device is preferably a trackpoint or button type of pointing device. A wired keyboard (also not shown) may also be used through keyboard connection 120, and a wired pointing device such as a mouse or trackball may be used through the mouse port 122. When a user has one or more of the remote control unit 106, the infrared keyboard, the wired keyboard and/or wired pointing device operable, the active device locks out all others until a prescribed period of inactivity has passed.

Figure 2:
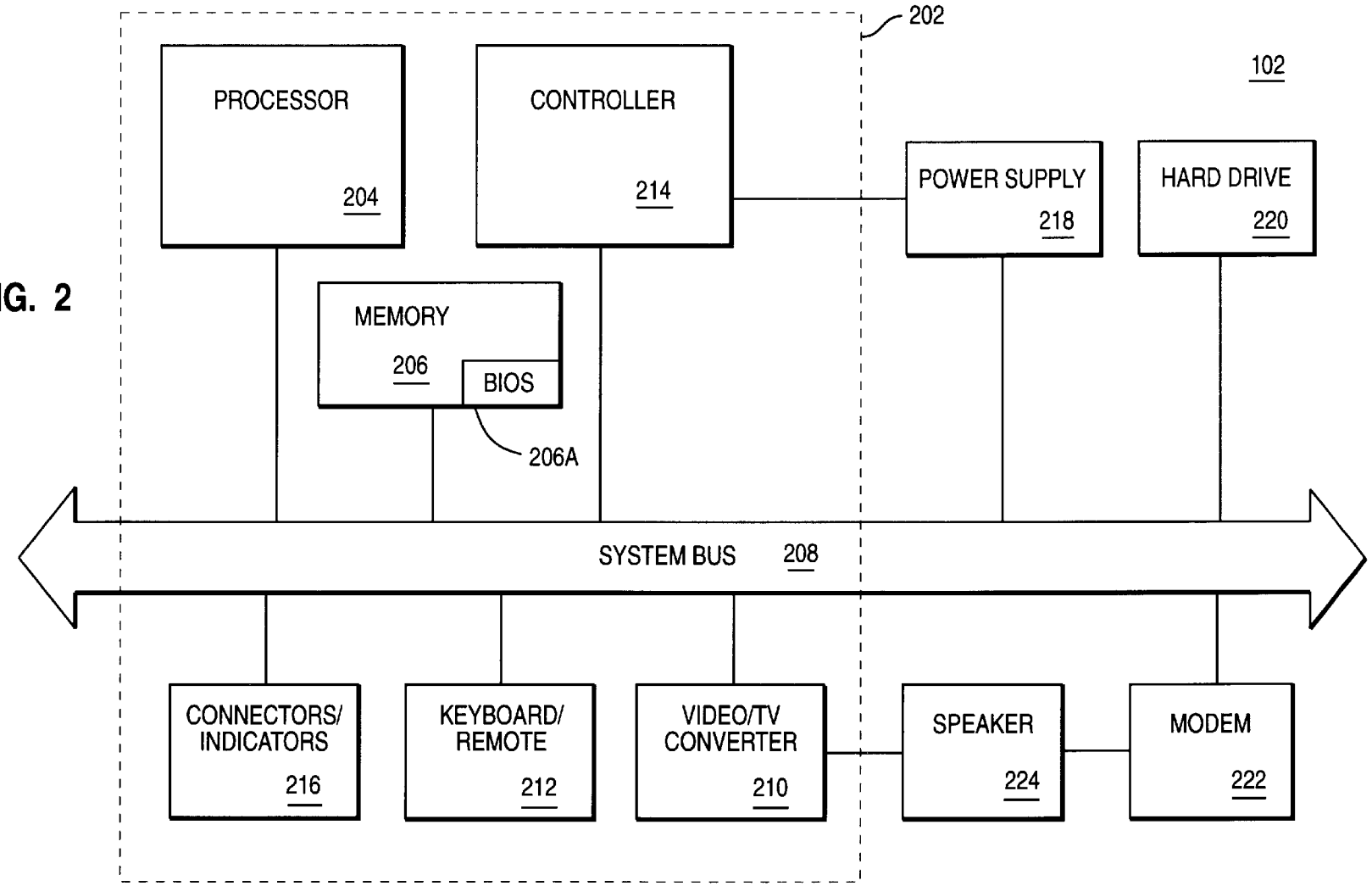
FIG. 2 is an architectural block diagram for the major components for a data processing unit designed according to one embodiment of the present invention.

Referring now to FIG. 2, a block diagram for the major components of data processing unit 102 in a preferred embodiment of the present invention is portrayed. As with conventional personal computers, data processing unit 102 includes a motherboard 202 containing a processor 204 and memory 206 connected to system bus 208. The processor 204 is preferably at least a 486-class processor operating at or above 100 MHz. Memory 206 may include cache memory and/or video RAM. The processor 204, the memory 206, and the system bus 208 operate in the same manner as corresponding components in a conventional data processing system.

The video/TV converter 210, located on the motherboard 202 and connected to the system bus 208, generates computer video signals for computer monitors, a composite television signal, and an S-Video signal. The functionality of video/TV converter 210 may be achieved through a Trident TVG9685 video chip in conjunction with an Analog Devices AD722 converter chip. The video/TV converter 210 may require loading of special operating system device drivers.

The keyboard/remote control interface unit 212 on the motherboard 202 receives keyboard codes through the controller 214, regardless of whether a wired keyboard/pointing device or an infrared keyboard/remote control is being employed. The infrared remote control unit 106 transmits signals which are ultimately sent to the serial port as control signals generated by conventional mouse or pointing device movements. Two buttons on the remote control unit 106 are interpreted identically to the two buttons on a conventional mouse, while the remainder of the buttons transmit signals corresponding to keystrokes on an infrared keyboard. Thus, the remote control unit 106 has a subset of the functions provided by an infrared keyboard.

Connectors/indicators 216 on the otherboard 202 provide some of the connections and indicators on data processing unit 102 described above. Other connections are associated with and found on other components. For example, telephone jacks 116 and 118 are located on the modem 222. The power indicator within connectors/indicators 216 is controlled by the controller 214.

External to the motherboard 202 in the depicted example are the power supply 218, the hard drive 220, the modem 222, and the speaker 224. The power supply 218 is a conventional power supply except that it receives a control signal from the controller 214 which effects shut down of all power to the motherboard 202, the hard drive 220, and the modem 222. In some recovery situations, removing power and rebooting is the only guaranteed method of resetting all of these devices to a known state. Thus, the power supply 218, in response to a signal from the controller 214, is capable of powering down and restarting the data processing unit 102.

The hard drive 220 contains operating system and applications software for data processing unit 102, which preferably includes: IBM DOS 7.0, a product of International Business Machines Corporation in Armonk, N.Y.; Windows 3.1, a product Microsoft Corporation in Redmond, Wash.; and Netscape Navigator, a product of Netscape Communications Corporation in Mountain View, Calif. Minor modifications of these software packages may be desirable to optimize performance of data processing unit 102. Hard drive 220 may also store data, such as list of favorite Internet sites or unviewed downloads from an Internet site. One of the preferred implementations of the invention is as sets of instructions resident in the random access memory of the computer system configured generally as described above. Until required by the computer system, the set of instructions may be stored in another computer memory, for example, in the hard disk 220. Although an Internet appliance will not generally use removable memory to minimize cost, the invention does have application to other general purpose computer systems in which removable memory is used. The sets of instructions may be stored in a removable memory such as an optical disk for eventual use in a CD-ROM drive or a floppy disk for eventual use in a floppy disk drive. The program may also be stored in the memory of another computer system to be sent over the network such as an external network as the Internet when desired. For example, the operating system of the Internet appliance can be updated remotely.

The modem 222 may be any suitable modem used in conventional data processing systems, but is preferably a 33.6 kbps modem supporting the V.42bis, V34bis, V.34, V.17 Fax, MNP 1-5, and AT command sets. To maintain the slim height of the data processing system 102, the modem 222 is preferably inserted into a slot mounted sideways on the motherboard 202.

The controller 214 is preferably one or more of the 805x family controllers. The controller 214 receives and processes input from the infrared remote control 106, the infrared keyboard, the wired keyboard, or the wired mouse. When one keyboard or pointing device is used, all others are locked out (ignored) until none have been active for a prescribed period. Then the first keyboard or pointing device to generate activity locks out all others. The controller 214 also directly controls all LED indicators except that indicating modem use. As part of the failure recovery system, the controller 214 specifies the boot sector selection during any power off on cycle.

Those skilled in the art will recognize that the components depicted in FIGS. 1A–1D and 2 and described above may be varied for specific applications or embodiments. Such variations in which the present invention may be implemented are considered to be within the spirit and scope of the present invention.

Figure 3:
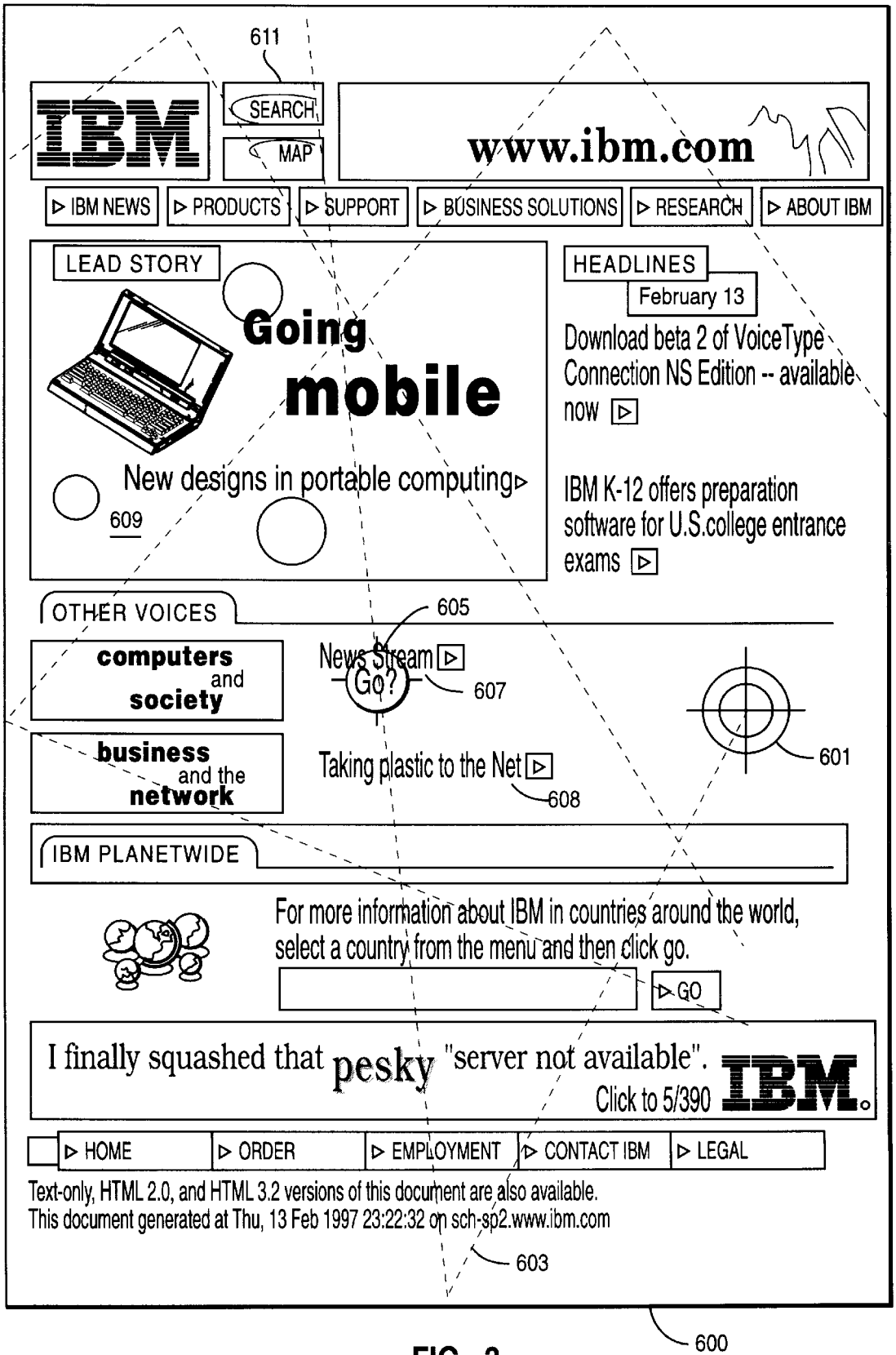
FIG. 3 shows a random bounce cursor as it is moved in a user interface.

The random bounce cursor is depicted in FIG. 3. The random bounce cursor 601 is found moving in window 600. After a period of inactivity, e.g., a minute to five minutes, the cursor enters a random bounce mode as it begins moving within the window. Alternatively, the random bounce cursor could be moving throughout the entirety of the display, potentially crossing several windows. The period of inactivity before the cursor enters the random bounce mode is preferably set by the system designer. However, a panel for setting the period could be presented to the user if a user configurable period were desired. However, in view of the intended audience to which the Internet applicant is directed, most users would not be inclined to configure the interface.

The path 603 which the random bounce cursor takes through the interface is preferably designed to cover the entire area of the window or display within a two to three minute cycle. Again, this cycle is a matter of design choice of the system designer. A set of predesigned paths or an algorithm based on the size and shape of the window could be alternatives to chart the random bounce cursor's movement through the interface.

When the cursor is over portions of the interface which are uninteresting, that is, where no user action may be attempted, it has its normal default appearance. For example, it is shown at 601 as a crosshairs cursor. when the cursor moves over a link or other interesting feature, it changes its appearance. At point 605, the cursor has changed to display the characters "GO?", in effect asking the user whether he wants to "go" to the link 607 over which the cursor is positioned. In the preferred embodiment, the appearance of the cursor is closely aligned to the actual actions which may be taken by the user.

In the preferred embodiment, the cursor may slow in its path once the system determines that the cursor is over an interesting feature such as a link in the interface. This allows the user to take action while the cursor is still over the object rather than having to backtrack to the object's position.

While the primary indication that the cursor is over an interesting site is the appearance of the cursor, optionally, the link or object over which the cursor is located may be also highlighted or otherwise emphasized. Lastly, the bounce process stops when user input is detected.

The random bounce cursor shows the user the available options in the interface without the user having to take any action of his own. The movement of the cursor helps the user locate the cursor in the interface. By making the available options known, the cursor encourages an otherwise reticent user to begin to discover the potential of the Internet.

Figure 4A:
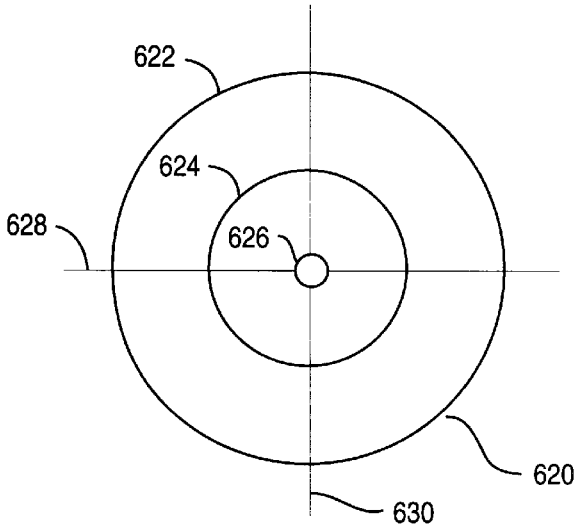
FIGS. 4A, 4B, 4C and 4D show the random bounce cursor as it would appear over various features in the user interface.

FIG. 4A shows the cursor in its normal appearance when it is not over an interesting feature of the interface. While the default appearance could be a conventional arrow, in the preferred embodiment, the crosshairs design in which concentric circles surrounding a hot point at the intersection of two crosshairs is presented. Animation further drawing the user's eye to the hot point is more intuitive to a novice user.

Figure 4B:
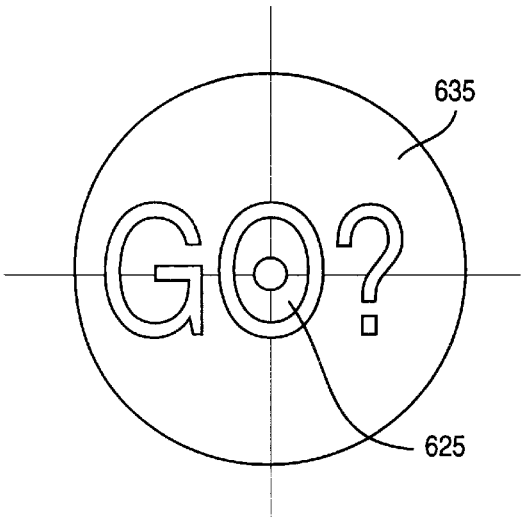

FIG. 4B shows the appearance of the cursor over a link in a preferred embodiment. In this embodiment, the central portion of the cursor is replaced by the characters "GO?". In effect, the cursor asks the question "do you want to "go" to this link". The reader will remember that in the preferred embodiment of the apparatus there is a "GO" button on the remote control and possibly on the keyboard as well. Multiple occurrences in the interface and hardware makes both the action desired and the means to accomplish that action intuitive to the user. More detail is discussed in the copending, commonly assigned application "Go Cursor" by V. Berstis, filed Feb. 18, 1997, Ser. No. 08/801,661 which is hereby incorporated by reference.

Figure 4C:
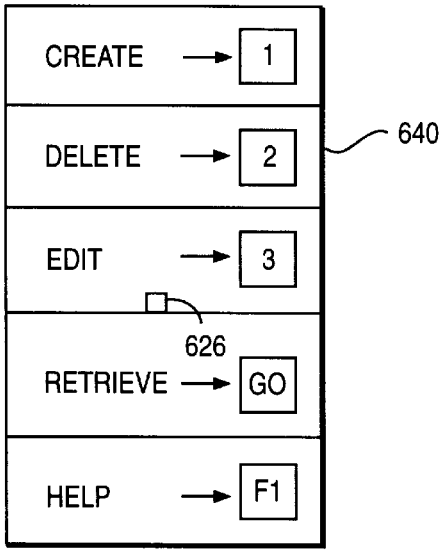

As shown in FIG. 4C, the cursor may also take the form of a menu. Each of the menu items explains the action with an arrow pointing to the picture of key which would activate that action. For example, creating an object may might be activated by pressing the "1" button on the remote control or keyboard of the data processing system. In the menu, it is preferred that the picture of the key look as realistic as possible so that the user makes the association. Also, as shown the hot spot 626 remains so that the user makes the association of the object which has these available actions. This type of cursor is explained in greater length and detail in the commonly assigned, co-pending application "Menu Cursor" by V. Berstis, Ser. No. 08/801,655, which is hereby incorporated by reference and co-pending application "Automatically Bring Up Menu of Options . . . " by V. Berstis, Ser. No. 08/801,655, which is hereby incorporated by reference. One skilled in the art would appreciate that the design of the cursor in the menu form can vary in detail and form.

Figure 4D:
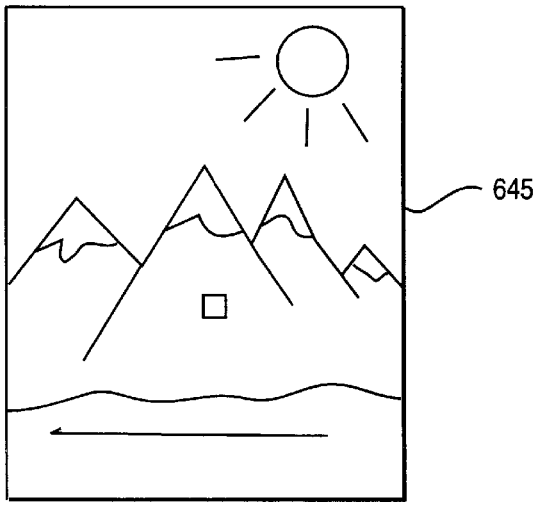

FIG. 4D shows the cursor 645 changed into a graphic image. The graphic image tells the user a little bit about the subject mapper could be viewed over a specific link. For example, as shown, the pointer icon 645 may be displayed as a picture of the mountain scene denoting Boulder, Colorado or skiing. Tables could be hard coded into the operating system for known and popular Web pages and the cursor presentation retrieved by table lookup. Alternative, the system might have a few graphical images are associated with words in a dictionary. If a word is found in the dictionary, the cursor is displayed with as the appropriate graphical image. The process of displaying visually stimulating graphics adds excitement to the interface.

Figure 5A:
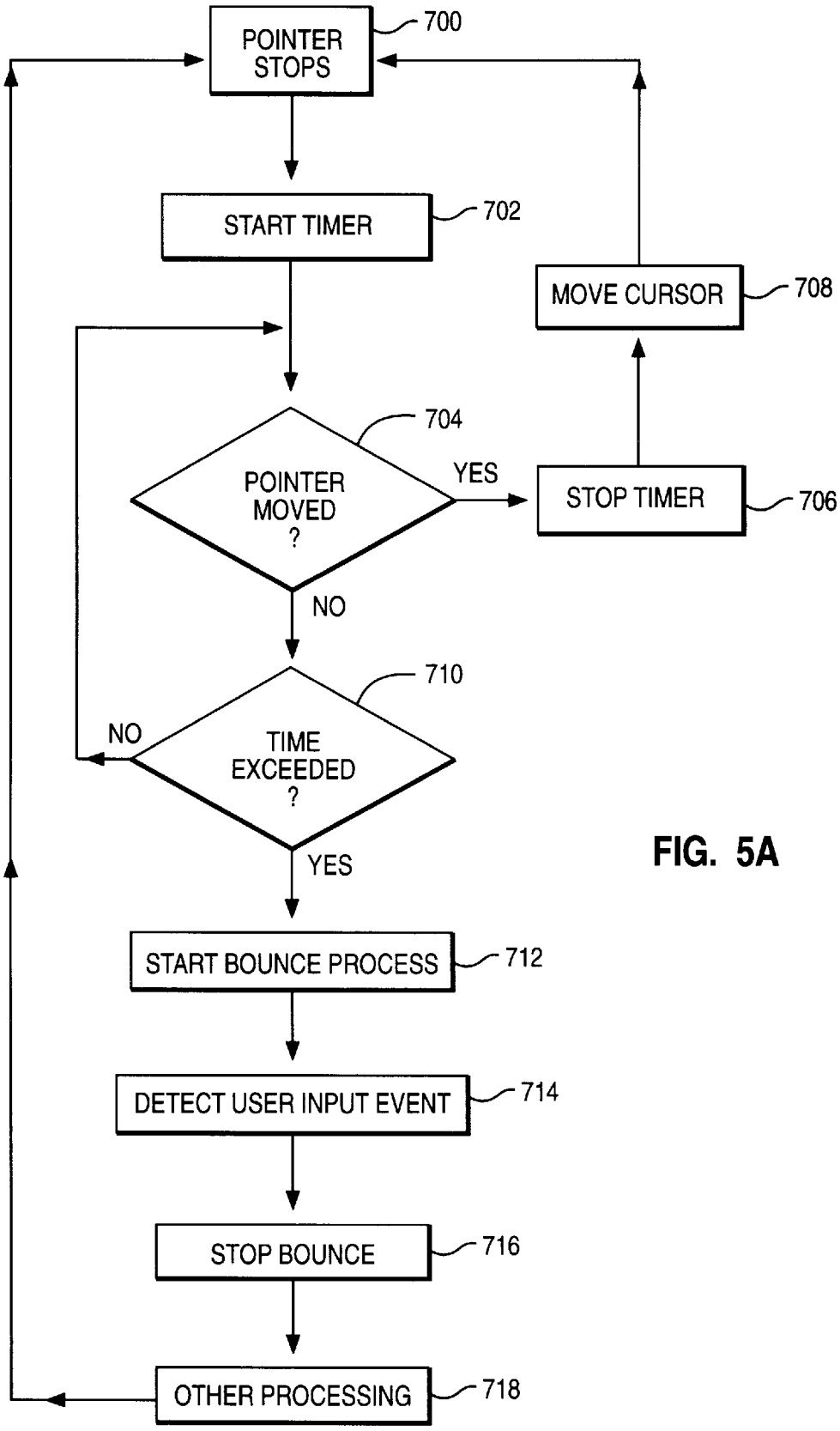
FIGS. 5A and 5B are flow diagrams of the processes taken by the system in presenting the random bounce cursor.
Figure 5B:
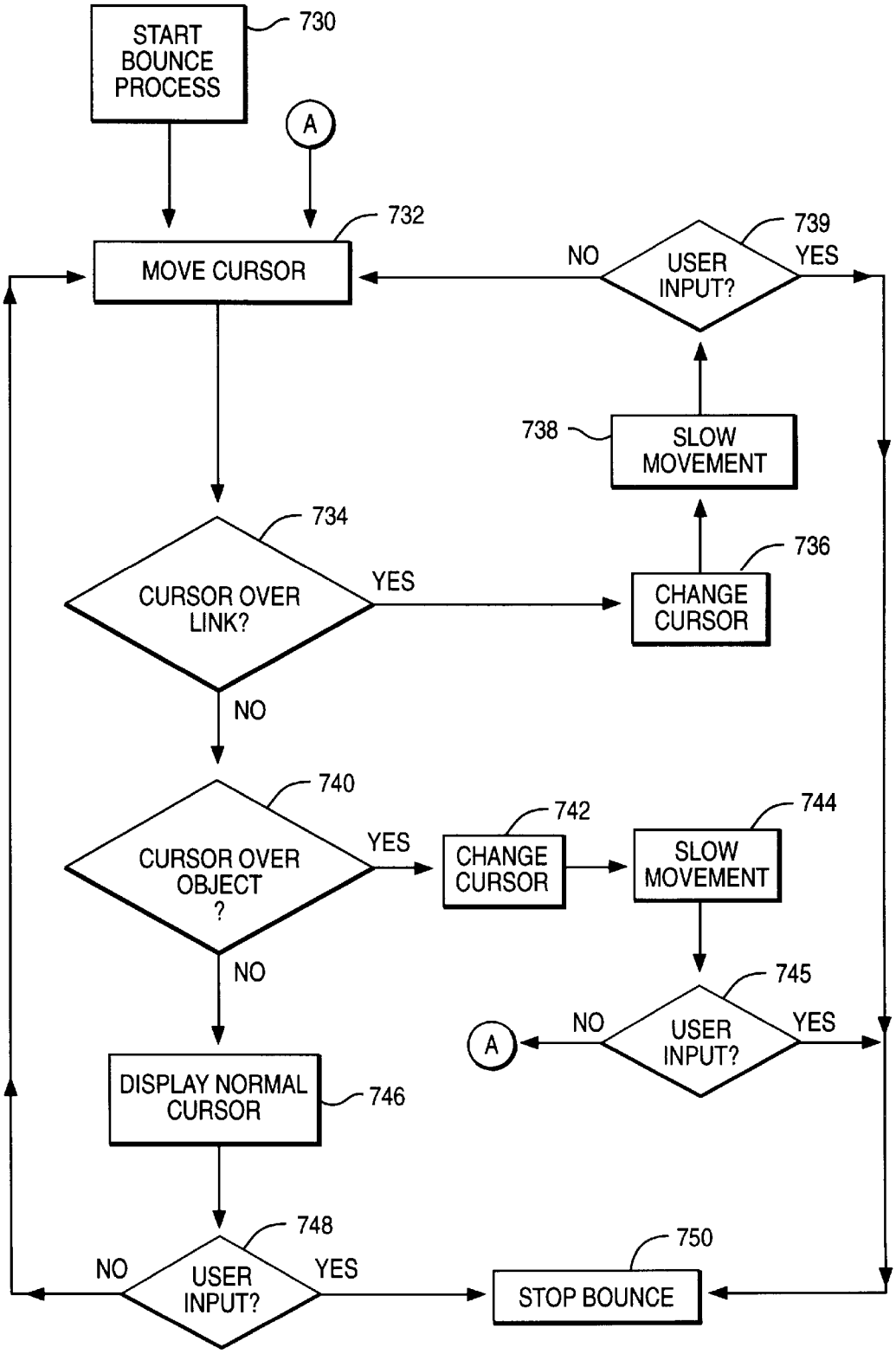

The process which the system takes to display the random bounce cursor is shown in the flow diagrams of FIGS. 5A and 5B. In step 700, the user has stopped pointer input. The step might be expanded to embrace all user input whether from the pointer device on remote control or from the depression of keys on the keyboard or remote control. In any case, after the cessation of user input, a timer is started in step 702. In step 704, a test determines whether there is further user input (from the pointing device on the remote control or keyboard). If there is user input, in step 706, the timer is stopped and reset. In step 708, the cursor is removed in response to the user input. The process returns to step 700 when the user input stops.

If the pointer has not been moved, the test in step 710 determines whether the time threshold has been exceeded, if not, the process returns to step 704. If the threshold has been exceeded, the bounce process is started in step 712. This process is shown in greater detail in FIG. 5B. At the detection of user input, step 714, the bounce process stops, step 716. At this point the system performs other processing as indicated by the user input.

The bounce process starts in step 730 when the time threshold is exceeded. In step 732, the system begins to move the cursor along the path designed to cover essentially the entire window or display area. As the cursor is moved, the test in step 734 determines whether the cursor is over a link. This type of information is available to the operating system from the browser such as Netscape Navigator. The network browser has obtained this information by reading the HTML file which is used to display the Web page. At each link to another Web page the HTML code indicates the presence of a link. If the cursor is over the link, in step 736, the cursor is changed appropriately. As shown in FIG. 4B this may be the "GO" cursor.

In step 738, the motion of the cursor along the path is slowed. This allows the user to act on the information which is being presented by the cursor. Eventually, the cursor will not be over a length in step 734. The process proceeds to the test in step 740 to determine whether the cursor is over an object having of selections attached, for example, an object in a tool bar. If the cursor is over an object with selectable actions, in step 742, these actions are retrieved from the operating system and formatted in a cursor which displays these actions and preferably how these actions might be initiated by the user. One such cursor is shown in FIG. 4C discussed above. As above, in step 744, the motion of the cursor is slowed so that the user might act contemporaneously as the cursor is positioned over the object. If there is user input, the test 745 exits to step 750 to stop the bounce process.

The cursor not over a link or object, the normal display cursor is shown in step 746. The test in step 748 determines whether there is user input. If so, the process is stopped in step 750. If not, the process returns to step 732 to continue movement of the cursor.

While the invention has been shown and described with reference to particular embodiments thereof, it will be understood by those skilled in the art that the foregoing and other changes in form and detail may be made therein without departing from the spirit and scope of the invention.

I claim:

1. A method for presenting a user interface for a computer system display, comprising the steps of:

starting a timer at cessation of user input;

determining that the timer has reached a predetermined threshold; and responsive to the timer reaching the predetermined threshold, entering a random bounce mode in which a cursor is continuously moved in the user interface.

2. The method as recited in claim 1 further comprising the step of exiting the random bounce mode once user input to the computer system is detected.

3. The method as recited in claim 1 wherein during the random bounce mode the cursor is moved along a path which substantially covers a window display area.

4. The method as recited in claim 1 further comprising the step of changing cursor appearance as the cursor moves over objects in the interface during the random bounce mode.

5. The method as recited in claim 4 wherein the cursor appearance is designed to inform a user how to activate actions associated with particular objects.

6. The method as recited in claim 5 further comprising the step of slowing the movement of the cursor in the random bounce mode over objects in the interface.

7. A system for presenting a user interface for a computer system display, comprising:

means for starting a timer at cessation of user input;

means for deter mining that the timer has reached a predetermined threshold; and means responsive to the timer reaching the predetermined threshold for entering a random bounce mode in which a cursor is continuously moved in the user interface.

8. The system as recited in claim 7 further comprising means for exiting the random bounce mode once user input to the computer system is detected.

9. The system as recited in claim 7 wherein during the random bounce mode the cursor is moved along a path which substantially covers a window display area.

10. The system as recited in claim 7 further comprising means for changing cursor appearance as the cursor moves over objects in the interface during the random bounce mode.

11. The system as recited in claim 10 wherein the cursor appearance is designed to inform a user how to activate actions associated with particular objects.

12. The system as recited in claim 11 further comprising means for slowing the movement of the cursor in the random bounce mode over objects in the interface.

13. A computer program product on a computer readable medium for presenting a user interface for a computer system display, comprising:

means for starting a timer at cessation of user input;

means for determining that the timer has reached a predetermined threshold; and means responsive to the timer reaching the predetermined threshold for entering a random bounce mode in which a cursor is continuously moved in the user interface.

14. The product as recited in claim 13 further comprising means for exiting the random bounce mode once user input to the computer system is detected.

15. The product as recited in claim 13 wherein during the random bounce mode the cursor is moved along a path which substantially covers a window display area.

16. The product as recited in claim 13 further comprising means for changing cursor appearance as the cursor moves over objects in the interface during the random bounce mode.

17. The product as recited in claim 16 wherein the cursor appearance is designed to inform a user how to activate actions associated with particular objects.

18. The product as recited in claim 17 further comprising means for slowing the movement of the cursor in the random bounce mode over objects in the interface.

* * * * *